US007661432B2

(12) United States Patent
Hosono

(10) Patent No.: US 7,661,432 B2
(45) Date of Patent: Feb. 16, 2010

(54) CIGARETTE FILTER CONTAINING ACTIVATED CARBON IMPREGNATED WITH SESAMOL

(75) Inventor: Kiyoshi Hosono, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 230 days.

(21) Appl. No.: 11/243,980

(22) Filed: Oct. 6, 2005

(65) Prior Publication Data

US 2006/0032511 A1 Feb. 16, 2006

Related U.S. Application Data

(63) Continuation of application No. PCT/JP2004/004244, filed on Mar. 26, 2004.

(30) Foreign Application Priority Data

Apr. 10, 2003 (JP) ..... 2003-106746

(51) Int. Cl.
*A24B 15/18* (2006.01)

(52) U.S. Cl. ..... 131/334; 131/335; 131/331

(58) Field of Classification Search ..... None
See application file for complete search history.

(56) References Cited

U.S. PATENT DOCUMENTS 3,667,478 A * 6/1972 Waterbury ..... 131/335
3,778,387 A * 12/1973 Urbonic et al. ..... 502/401
4,977,871 A * 12/1990 Brownawell et al. .... 123/196 A
5,348,755 A * 9/1994 Roy ..... 426/541
5,746,231 A * 5/1998 Lesser et al. ..... 131/334

FOREIGN PATENT DOCUMENTS

| | | | |
|---|---|---|---|
| JP | 62-232371 | A | 10/1987 |
| JP | 6-62824 | | 3/1994 |
| JP | 6-78739 | A | 3/1994 |
| JP | 8-208685 | A | 8/1996 |
| JP | 2001-526913 | | 12/2001 |
| JP | 2002-363027 | A | 12/2002 |
| JP | 2003-62420 | A | 3/2003 |
| JP | 2003-102457 | A | 4/2003 |
| RU | 2 155 529 | C2 | 9/2000 |
| WO | WO-98/15197 | A1 | 4/1998 |
| WO | WO-03/013285 | A1 | 2/2003 |

OTHER PUBLICATIONS

Smeds, et al. "Quantification of a Broad Spectrum of Lignans in Cereals, Oilseeds, and Nuts", J. Agric. Food Chem. 2007, 55, 1337-1346.*

Kikugawa et al., Particpation of Sesamol in Stability of Sesame Oil, Journal of the American Oil Chemists' Society, vol. 60, No. 8 (Aug. 1983), pp. 1528-1533.*

Free-Radical Chemistry of Cigarette Smoke and Its Toxicological Implications, Daniel F. Church and William A. Prior, Environmental Health Perspectives, vol. 64, pp. 111-126, 1985.

Formation Mechanism for Gas-Phase Radicals from Cigarette Smoke Safety Engineering, by Kaneko et al., vol. 29, pp. 20-26, 1990.

* cited by examiner

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A cigarette filter is characterized in that sesame lignan (which is at least one selected from the group consisting of sesamin, sesamol, sesaminol, sesamolinol, sesamolin and pinoredinol) is added to the filter.

1 Claim, No Drawings

CIGARETTE FILTER CONTAINING ACTIVATED CARBON IMPREGNATED WITH SESAMOL

CROSS REFERENCE TO RELATED APPLICATIONS

This is a Continuation Application of PCT Application No. PCT/JP2004/004244, filed Mar. 26, 2004, which was published under PCT Article 21(2) in Japanese.

This application is based upon and claims the benefit of priority from prior Japanese Patent Application No. 2003-106746, filed Apr. 10, 2003, the entire contents of which are incorporated herein by reference.

BACKGROUND OF THE INVENTION

1. Field of the Invention

The present invention relates to a cigarette filter.

2. Description of the Related Art

It has been pointed out that active oxygen species and free radicals generally have high reactivity and have relevance to various diseases. It is known to the art that free radicals are contained in cigarette mainstream smoke. Thus, attentions are paid to removal of the free radicals from the cigarette mainstream smoke. It is assumed that the free radicals (alkyl radicals and alkoxy radicals) contained in the vapor phase of the cigarette mainstream smoke excluding the particulate phase component are originated from precursors of nitrogen monoxide and olefins such as isoprene (see Daniel F. Church and William A. Pryor, Environmental Health Perspectives, Vol. 64, pp. 111-126 (1985); and Kaneko et al, Safety Engineering, Vol. 29, pp. 20-26 (1990)). It should be noted that the vapor-phase free radicals cannot be removed with an ordinary fibrous bed filter such as an acetate filter and a paper filter.

Conventionally, it has been attempted to reduce the free radicals by adding various antioxidants to the cigarette filter.

For example, it is known an example of a filter to which a radical scavenger such as benzoquinone and vitamin C is added (see Japanese Patent Application No. 62-232371). However, these radical scavengers are incapable of producing a sufficient effect of reducing the free radicals.

Also, it is known another example of a filter to which an antioxidant derived from soybean ferment is added (see Japanese Patent Application No. 6-62824). However, since measurements are made only for active oxygen species in this document, whether the antioxidant has the effect of reducing the free radicals is unknown.

Further, it is known another example of a filter to which rosemary extract is added (see Japanese Patent Publication (Kohyo) No. 2001-526913). However, since the rosemary extract has an aroma, there is a possibility that it affects taste and flavor of the cigarette.

An object of the present invention is to provide a cigarette filter capable of reducing vapor-phase free radicals without affecting taste and flavor of the cigarette.

BRIEF SUMMARY OF THE INVENTION

A cigarette filter according to the present invention is characterized in that sesame lignan is added to the filter.

Sesame lignan used in the present invention is known as an antioxidant contained in sesame. The sesame lignan added to a cigarette filter in the present invention may be an extract from sesame or a synthetic substance. As the sesame lignan, specifically, at least one selected from the group consisting of sesamin, sesamol, sesaminol, sesamolinol, sesamolin and pinoredinol is used.

In the cigarette filter according to the present invention, it is preferable that the sesame lignan is added to the filter in a form a porous material impregnated with the sesame lignan. The porous material is not particularly limited and includes activated charcoal, zeolite, and silica/alumina.

In the present invention, it is preferable that the addition amount of the sesame lignan be 0.01 to 300 mg per filter.

DETAILED DESCRIPTION OF THE INVENTION

The present inventor has examined various antioxidants added to a cigarette filter as to the effect of reducing vapor-phase free radicals.

As a result, the present inventor has found that it is possible to reduce the vapor-phase free radicals without affecting the taste and flavor by adding sesame lignan (such as sesamin, sesamol, sesaminol, sesamolinol, sesamolin or pinoredinol) to the filter.

Methods of adding sesame lignan to a cigarette filter includes: a method of adding a powder or granulated product of sesame lignan to a filter (wherein the sesame lignan is uniformly added to filter fiber or is added to a cavity portion between filter segments); a method of coating acetate tow with a sesame lignan solution; and a method of impregnating a porous material such as activated charcoal with sesame lignan, followed by producing a filter using the porous material. It is also possible to combine these methods.

If a porous material such as activated charcoal impregnated with sesame lignan is used, it is possible to bring mainstream smoke into contact with sesame lignan on a large area, which would improve the effect of reducing the vapor-phase free radicals. In this case, the amount of sesame lignan is preferable set to 0.1 to 5% based on the activated charcoal.

The reason that the addition amount of the sesame lignan is set to 0.01 to 300 mg per filter is as follows. If the addition amount is smaller than 0.01 mg per filter, it is impossible to obtain the effect of removing the free radicals. If the addition amount exceeds 300 mg per filter, such an adverse effect as excessively high ventilation resistance is caused.

EXAMPLES

In the Examples and Comparative Examples below, the following method of (a) or (b) was used to add sesamol, which is a type of sesame lignan, to a filter.

(a) Manufacture of a Filter to which Sesamol Powder is Added:

In forming a filter with a filter winding machine, sesamol powder was added to the filter. In this step, the sesamol powder was uniformly dispersed onto spread acetate tow using a vibratory conveyer. The acetate fiber used had single yarn fineness of 3 deniers. The addition amount of sesamol was determined from the weight difference between the filter having sesamol added thereto and the filter not having sesamol added thereto. The maximum addition amount of sesamol was about 100 mg per filter. If the addition amount is further increased in this method, the ventilation resistance is rendered so high that it exceeds an allowable quality range within which the cigarette filter is applicable. It should be noted that use of a granulated product of the sesamol powder makes possible to increase the addition amount of sesamol.

(b) Manufacture of Charcoal Filter to which Activated Charcoal Impregnated with Sesamol is Added:

Sesamol was dissolved in ethanol, activated charcoal was put in the resultant solution, and the solution was left to stand while stirring intermittently. The solution was filtered with a filter paper, and the activated charcoal was vacuum-dried so as to be impregnated with sesamol. By measuring the absorbance (wavelength of 280 nm) of the filtrate and comparing the sesamol concentration before impregnation with that after impregnation, the impregnation amount of sesamol to the activated charcoal was calculated. Then, a charcoal filter having activated charcoal impregnated with sesamol added to the acetate fiber was produced by an ordinary forming method.

Example 1

An acetate filter to which sesamol powder was added in an amount of 38 mg/filter was produced by the method (a).

Example 2

An acetate filter to which sesamol powder was added in an amount of 96 mg/filter was produced by the method (a).

Example 3

Activated charcoal impregnated with 0.2% by weight of sesamol was prepared by the method (b), and then a charcoal filter to which the impregnated charcoal was added in an amount of 30 mg/filter was produced.

Example 4

Activated charcoal impregnated with 0.5% by weight of sesamol was prepared by the method (b), and then a charcoal filter to which the impregnated charcoal was added in an amount of 30 mg/filter was produced.

Example 5

Activated charcoal impregnated with 1.1% by weight of sesamol was prepared by the method (b), and then a charcoal filter to which the impregnated charcoal was added in an amount of 30 mg/filter was produced.

Example 6

Activated charcoal impregnated with 4.5% by weight of sesamol was prepared by the method (b), and then a charcoal filter to which the impregnated charcoal was added in an amount of 30 mg/filter was produced.

Example 7

Activated charcoal impregnated with 1.1% by weight of sesamol was prepared, and then a filter to which the impregnated charcoal and sesamol powder were added was produced. The amount of impregnated charcoal was set to 30 mg/filter, and amount of the sesamol powder was set to 42 mg/filter.

Comparative Example 1

An ordinary acetate filter to which sesamol was not added was used.

Comparative Example 2

Activated charcoal impregnated with 1.0% by weight of vitamin C was prepared, and then a charcoal filter to which the impregnated charcoal was added in an amount of 30 mg/filter was produced.

A cigarette was manufactured by using each of the filters described above. Then, the free radical removal rate was calculated by the method (c), and the taste and flavor of the cigarette was evaluated by the method (d).

(c) Measurement of the Vapor-phase Free Radicals and Calculation of the Free Radical Removal Rate:

Benzene in which N-tert-butyl-α-phenylnitron (PBN) was dissolved was used as a trapping solution. The trapping solution was put in a gas absorption washing bottle and held at 10° C. A cigarette was smoked under the standard smoking conditions, and the vapor phase of the mainstream smoke passing through a Cambridge filter was trapped by the trapping solution. The solution after trapping was deaerated with an argon gas, and the amount of the free radicals was determined with an electron spin resonance apparatus (ESR). The free radical removal rate was calculated according to the formula given below:

Removal rate (%)=100 {1−(amount of free radicals measured)/(amount of free radicals measured in Comparative Example 1)}.

(d) Evaluation of Taste and Flavor

The taste and flavor of the cigarette was evaluated in a scale of one to five by expert panel.

Table 1 shows the results of the evaluation.

TABLE 1

| | Free radical removal rate | Evaluation of taste and flavor |
|---|---|---|
| Example 1 | 13.3% | 5 |
| Example 2 | 18.2% | 5 |
| Example 3 | 11.2% | 5 |
| Example 4 | 31.8% | 5 |
| Example 5 | 30.3% | 5 |
| Example 6 | 19.8% | 5 |
| Example 7 | 35.5% | 5 |
| Comparative Example 1 | 0% | 5 |
| Comparative Example 2 | 9.0% | 4 |

As apparent from Table 1, the filter for each of Examples 1 to 7 to which sesamol was added exhibited a free radical removal rate higher than that of the filter for Comparative Example 2 to which vitamin C was added, without affecting the taste and flavor as well.

As described above, the present invention makes it possible to provide a cigarette filter that permits reducing the vapor-phase free radicals without affecting the taste and flavor.

What is claimed is:

1. A cigarette filter, wherein the filter contains activated charcoal in an amount of 30 mg/filter and the activated charcoal is impregnated with sesamol in a range of 0.2 to 4.5% by weight.

* * * * *